US011633055B2

(12) United States Patent
Henry et al.

(10) Patent No.: US 11,633,055 B2
(45) Date of Patent: Apr. 25, 2023

(54) BEVERAGE CONTAINER

(71) Applicant: Skip Hop, Inc., New York, NY (US)

(72) Inventors: Lou Henry, Scarsdale, NY (US); Benjamin Bearsch, Brooklyn, NY (US)

(73) Assignee: Skip Hop, Inc., New York, NY (US)

( * ) Notice: Subject to any disclaimer, the term of this patent is extended or adjusted under 35 U.S.C. 154(b) by 0 days.

(21) Appl. No.: 17/010,976

(22) Filed: Sep. 3, 2020

(65) Prior Publication Data

US 2022/0061561 A1 Mar. 3, 2022

(51) Int. Cl.

| | |
|---|---|
| ***A47G 19/22*** | (2006.01) |
| ***B65D 47/08*** | (2006.01) |
| ***B65D 51/24*** | (2006.01) |
| ***B65D 51/18*** | (2006.01) |

(52) U.S. Cl.

CPC ..... *A47G 19/2272* (2013.01); *B65D 47/0857* (2013.01); *B65D 51/18* (2013.01); *B65D 51/242* (2013.01)

(58) Field of Classification Search

CPC ..... A47G 19/2272; A47G 19/2222; A47G 19/2266; A47G 21/18; A47G 21/184; A47G 21/185; B65D 47/0857; B65D 47/065; B65D 47/066; B65D 51/18; B65D 51/242; B65D 25/44; B65D 25/46; B65D 25/465; B65D 75/5861; B65D 47/08; B65D 47/0876; B65D 47/046; B65D 25/40; B65D 25/48; B65D 51/1644

USPC ..... 220/212.5, 826, 822

See application file for complete search history.

(56) References Cited

U.S. PATENT DOCUMENTS

| | | | | |
|---|---|---|---|---|
| 10,512,347 | B1 * | 12/2019 | Shepard | B65D 47/148 |
| 2011/0284538 | A1 * | 11/2011 | Valderrama | A47G 19/2272 220/212.5 |
| 2014/0069946 | A1 * | 3/2014 | Gubitosi | A47G 19/2272 220/713 |
| 2016/0114937 | A1 * | 4/2016 | Hylton | B65D 47/0857 206/519 |
| 2016/0120343 | A1 * | 5/2016 | Liang | A47G 19/2272 220/303 |
| 2017/0208974 | A1 * | 7/2017 | Zhang | B65D 47/0857 |
| 2017/0340148 | A1 * | 11/2017 | Chen | B65D 47/32 |
| 2020/0170426 | A1 * | 6/2020 | Michaels | A47G 19/2266 |

* cited by examiner

*Primary Examiner* — Robert Poon

(74) *Attorney, Agent, or Firm* — Greenberg Traurig, LLP

(57) ABSTRACT

A beverage container for drinking including a base portion for holding a beverage, a lid portion that is selectively attachable to the base. The lid portion includes first spout through which a beverage in the container may be consumed, a second spout through which the beverage may be consumed, and a cover assembly configured to selectively cover and expose the first and second spouts.

24 Claims, 8 Drawing Sheets

BEVERAGE CONTAINER

BACKGROUND

Children's beverage containers are sometimes training containers that allow children to think without spilling. Such containers typically include a cup and a lid having an integrated drinking spout. While beverage containers of this type allow a child to drink, there are some drawbacks. For example, one problem associated with prior art beverage containers is that they do not provide flexibility in adapting to the child's needs as the child gets older.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

In accordance with one aspect of this invention a beverage container for drinking including a base portion for holding a beverage, a lid portion that is selectively attachable to the base. The lid portion includes first spout through which a beverage in the container may be consumed, a second spout through which the beverage may be consumed, and a cover assembly configured to selectively cover and expose the first and second spouts.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Various embodiments of the present invention relate to a beverage container that has multiple different sized and/or shaped drinking spouts, such as an oblong spout and a straw-like spout, to obtain liquid from the container. This may be achieved, for example, by providing the various spouts in a lid portion of the container, which may then be selectively covered and exposed during use. Consequently, various embodiments can be more versatile, and their useful life may be prolonged.

Figure 1:
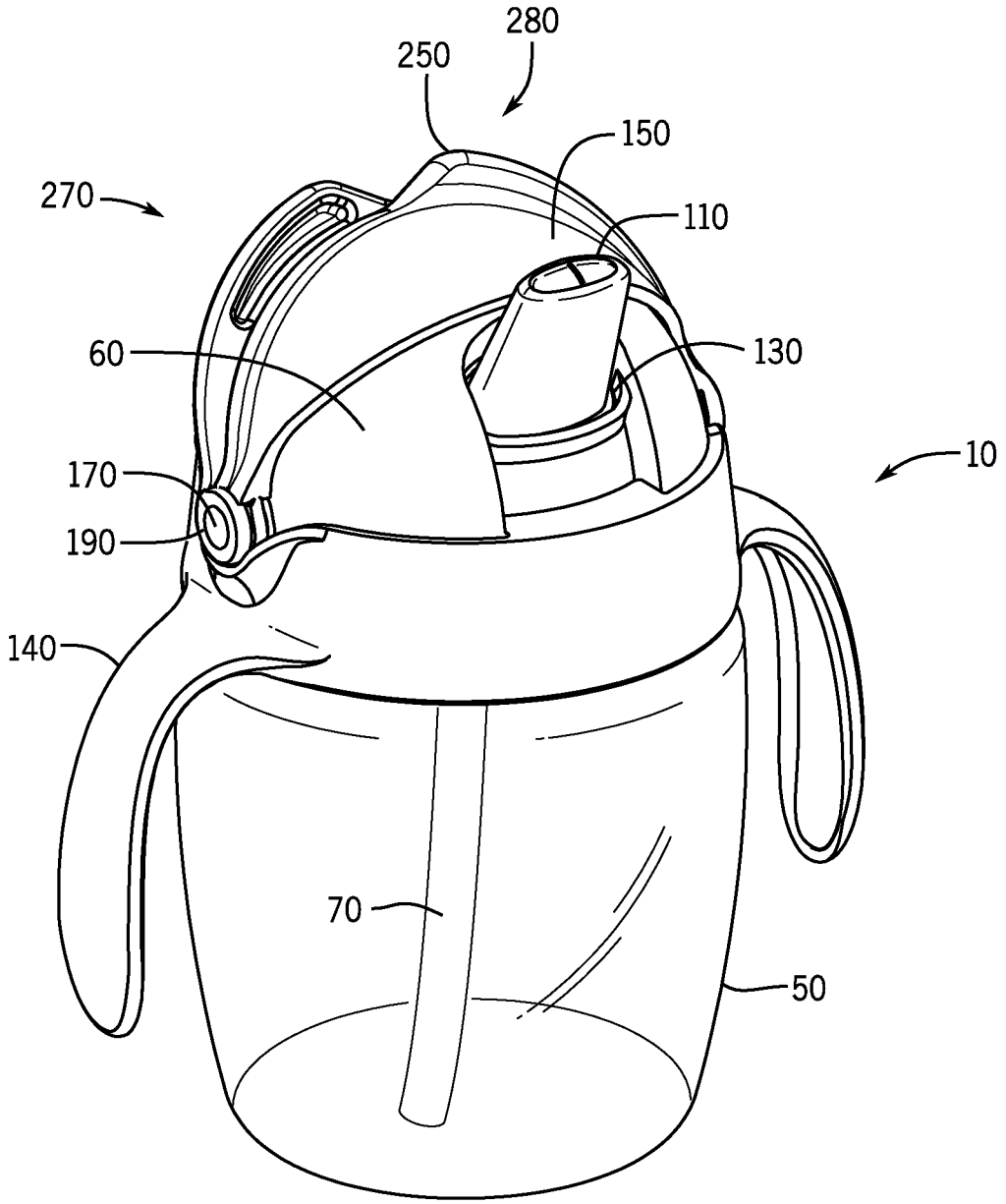
FIG. 1 is a front perspective view of a beverage container for an infant, in accordance with various embodiments.

FIG. 1 shows a front perspective view of a beverage container 10 in a first configuration, in accordance with various embodiments of the present invention. Although the illustrated embodiment depicts a cup, it should be appreciated that other embodiments may involve other types of containers, such as mugs, jugs, bottles and cans. The beverage container 10 may include a lid portion 270 and a base portion 50. The lid portion includes a main body 60. The lid portion may include two or more apertures though which two or more drinking spouts may extend therethrough. In the illustrated embodiment, the lid portion 270 includes a first spout 110 that passes through a first aperture 130 of the main body 60 and a second spout 80 that passes through a second aperture 290, wherein the second spout 80 has a different size and/or shape than the first spout. For example, in the illustrated embodiment, the first spout 110 is an oblong "sippy" style training spout, and the second spout 80 is a straw-like spout. The first and second spouts 110, 80 may be made of a resilient material, such as silicone or other suitable materials. The first spout 110 allows liquid to be withdrawn, but in some embodiments may also prevent liquid from freely leaking out. In the configuration of FIG. 1, the first spout 110 is exposed, and the second spout 80 is covered. The beverage container 10 may further include a cover assembly 280 that includes one or more covers 150, 160 for selectively covering and exposing the spouts. In the illustrated embodiment, the cover assembly 280 includes a first cover 150 for selectively covering and exposing the first spout 110 and a second cover 160 for selectively covering and exposing the second spout 80. In the configuration of FIG. 1, the first cover 150 is in a raised position to expose the first spout 110, and the second cover 160 is in a lowered position to cover the second spout 80. The first cover 150 may further include a first cover selector 250, e.g., a raised ridge that allows for a user's finger to more easily manipulate the first cover 150 between a closed position and an open position. The first cover 150 is pivotable about first and second male hinges 190, 200 via a first and second apertures 170, 180. The beverage container 10 may also include a handle portion 140 comprising one or more handles.

Figure 2:
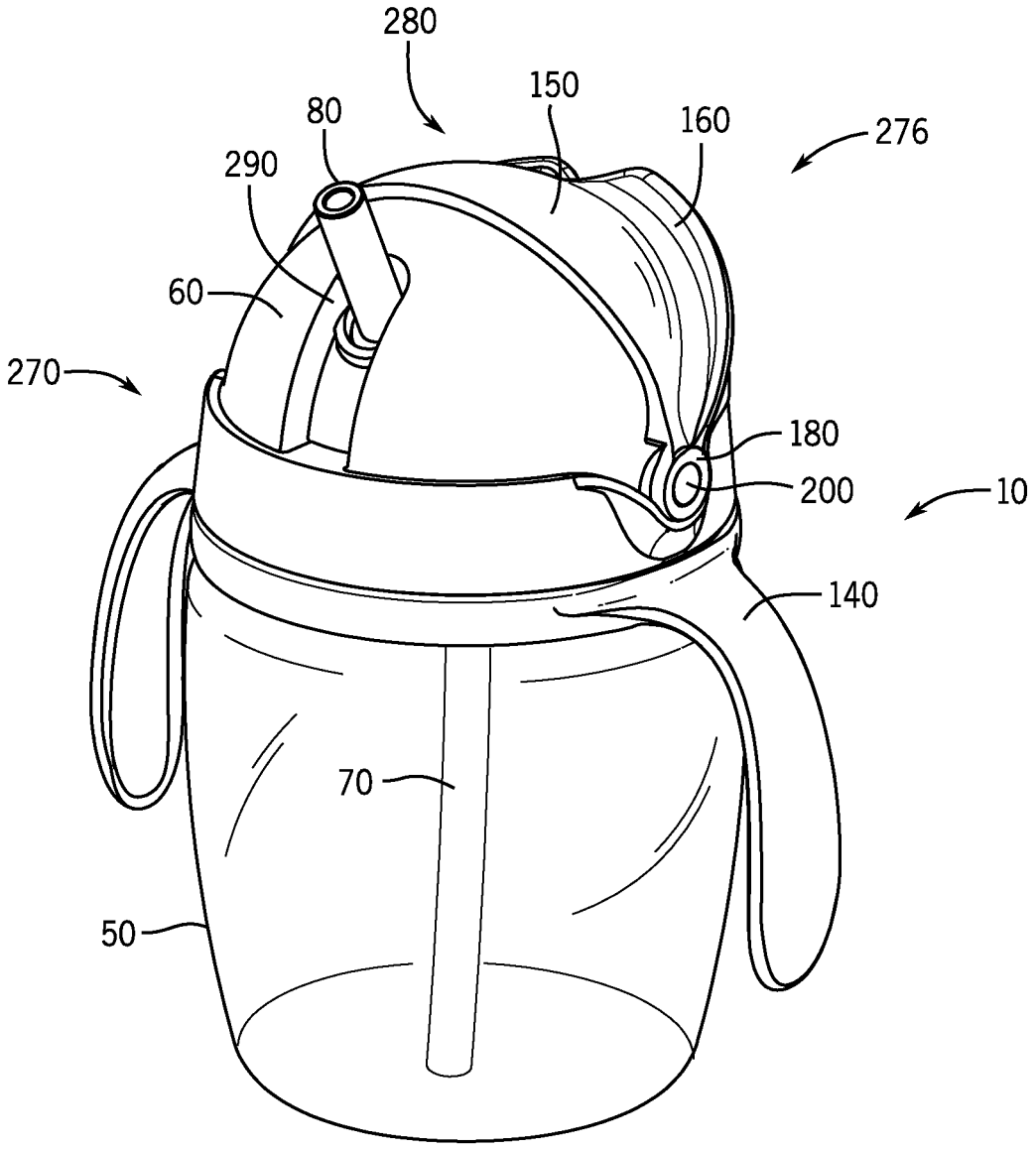
FIG. 2 is a rear perspective view of a beverage container for an infant, in accordance with various embodiments.

FIG. 2 shows a rear perspective view of the beverage container 10 in a second configuration, in accordance with various embodiments of the present invention. In the second configuration, the first cover 150 is lowered to cover the first spout 110, and the second cover 160 is raised to expose the second spout 80, which in the illustrated embodiment is a straw-like spout. As shown, the second cover 160 may further include a second cover selector 260, e.g., a raised ridge that allows for a user's finger to more easily manipulate the second cover 160 between a closed position and an open position. The second cover 160 is pivotable about first and second male hinges 190, 200 via a first and second apertures 170, 180.

Figure 3:
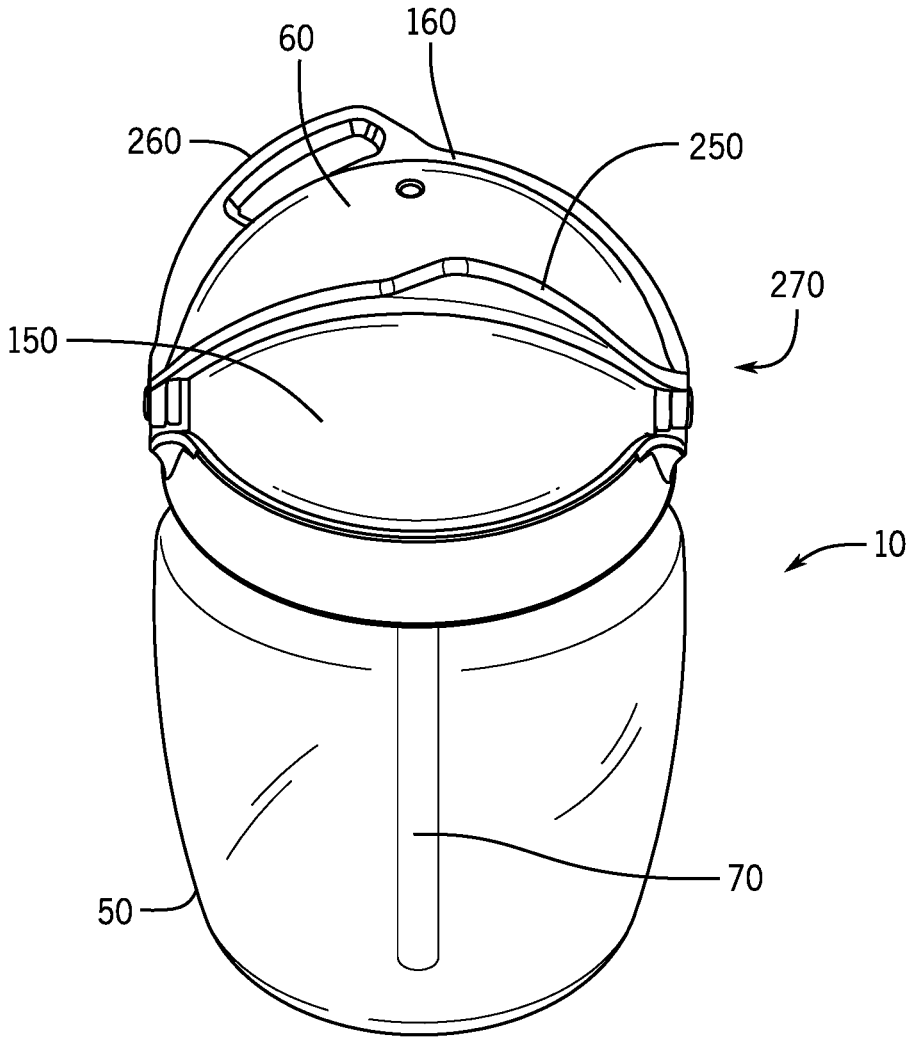
FIG. 3 is a rear view of a beverage container for an infant, in accordance with various embodiments.

FIG. 3 shows a perspective view of the beverage container 10 in a third configuration. In the third configuration, the first cover 150 is lowered to cover the first spout 110, and the second cover 160 is lowered to cover the second spout 80, so as to substantially close off the beverage container and prevent leaking from the spouts 80, 110.

Figure 4:
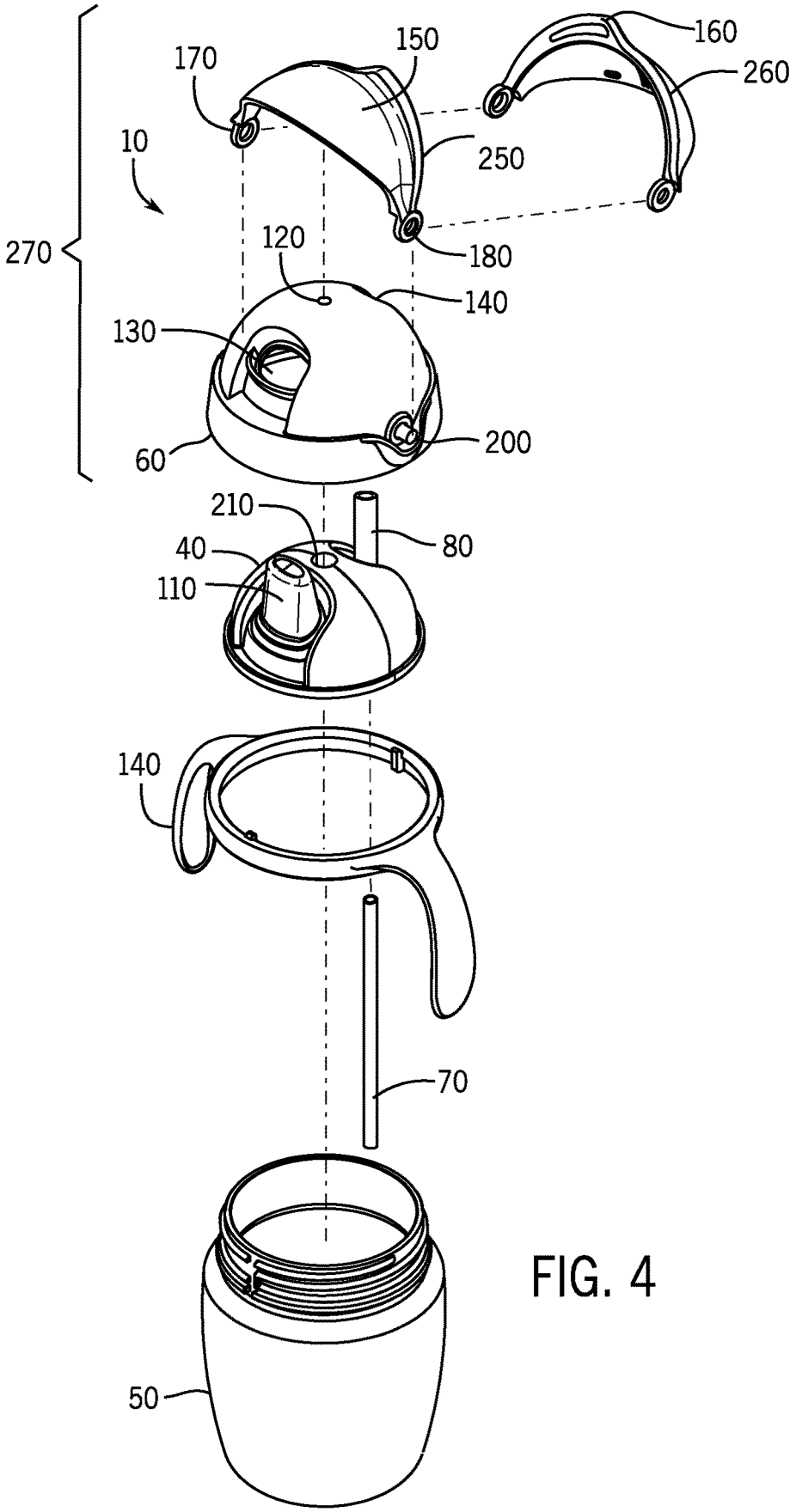
FIG. 4 is an exploded view of a beverage container for an infant, in accordance with various embodiments.
Figure 5:
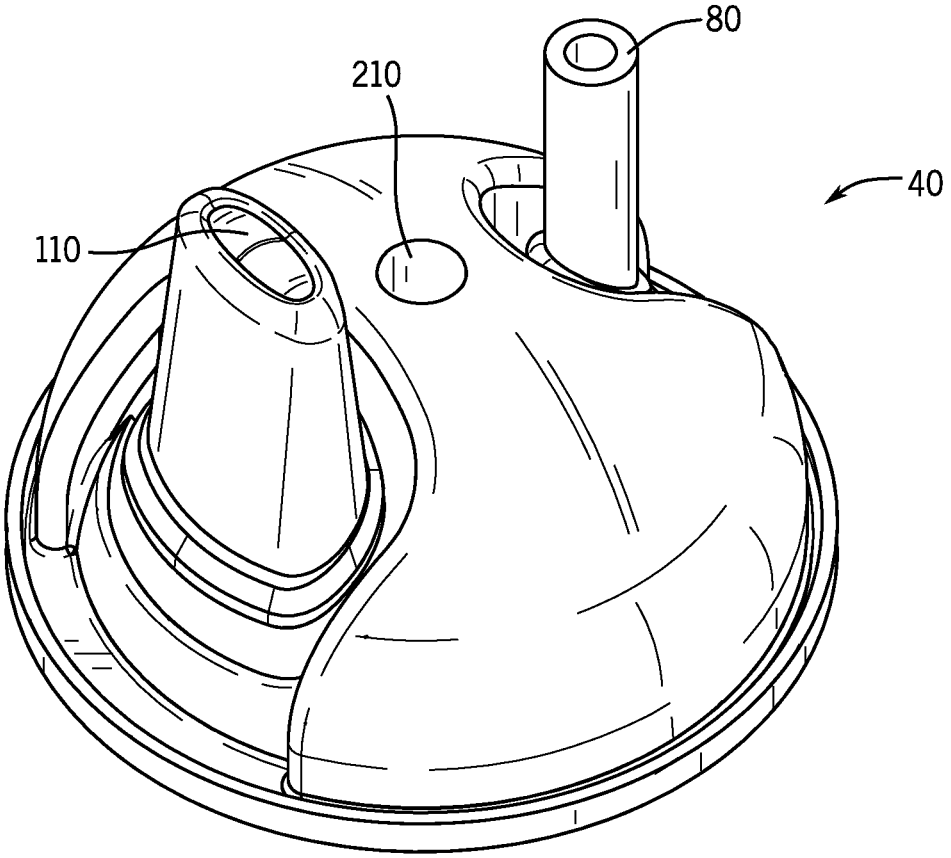
FIG. 5 is a front perspective view of a lid portion to the beverage container for an infant, in accordance with various embodiments.
Figure 6:
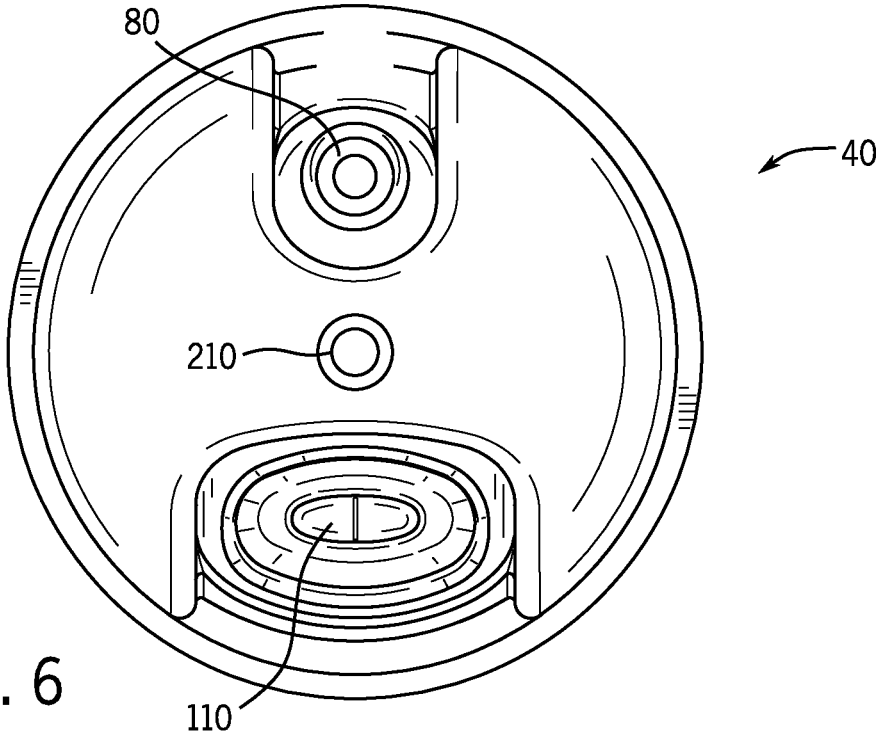
FIG. 6 is a top view of a lid portion to the beverage container for an infant, in accordance with various embodiments.
Figure 7:
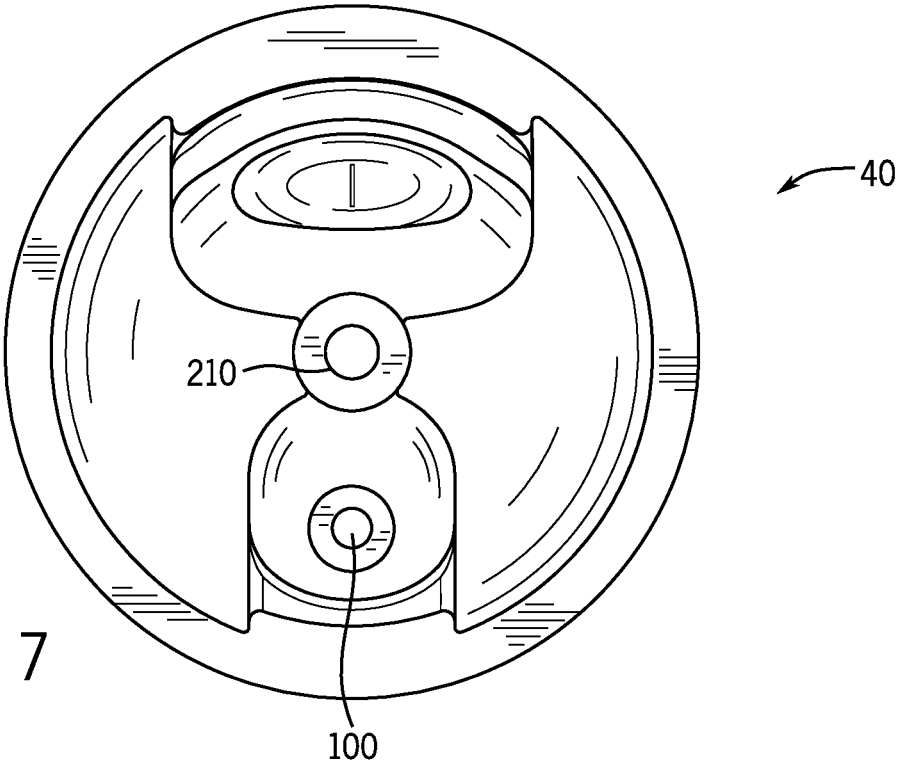
FIG. 7 is a bottom view of a lid portion to the beverage container for an infant, in accordance with various embodiments.
Figure 8:
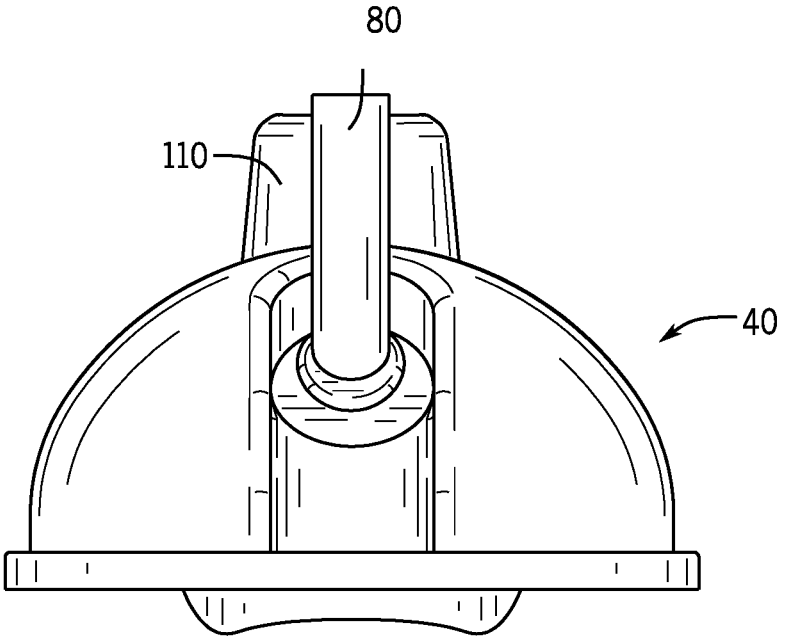
FIG. 8 is a front view of a lid portion to the beverage container for an infant, in accordance with various embodiments.
Figure 9:
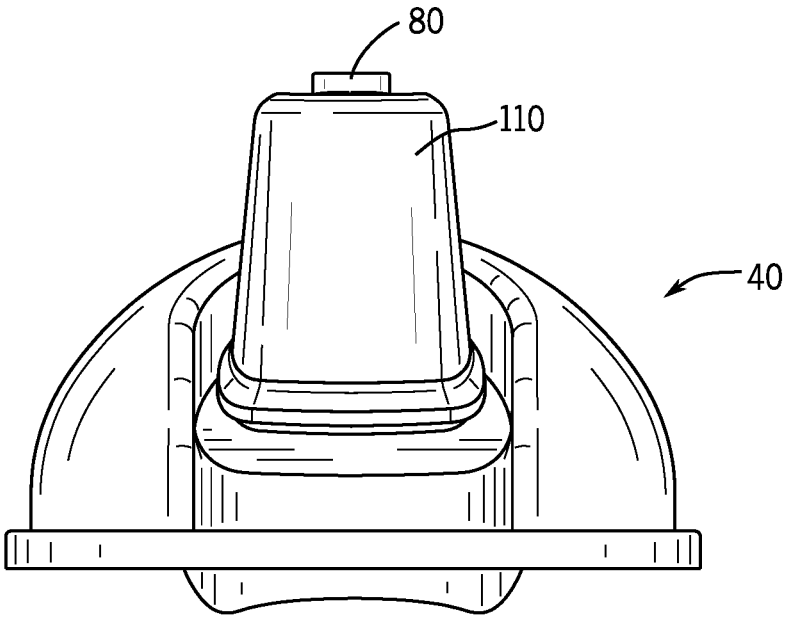
FIG. 9 is a front view of a lid portion to the beverage container for an infant, in accordance with various embodiments.
Figure 10:
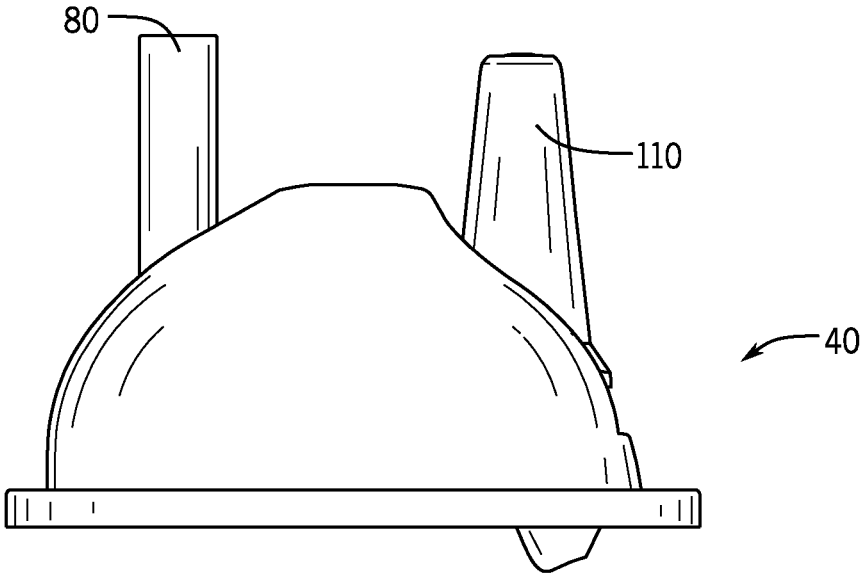
FIG. 10 is a rear view of a lid portion to the beverage container for an infant, in accordance with various embodiments.

FIG. 4. is an exploded view of the beverage container 10, in accordance with various embodiments of the present invention. As shown, the base portion 50 may be threaded, and the lid portion 270 may be complementarily threaded so that the two may be threadedly coupled. The beverage container 10 may also include a straw extension 70, e.g., that may be selectively attachable to the internal end of the straw-like second spout 80. Although the straw extension 70 is depicted as removable in the illustrated embodiment, it should be appreciated that the straw extension 70 alternatively may be permanently affixed to the spout insert 40.

As shown in FIG. 4, the first and second spouts 110, 80 may be formed together in a unitary spout insert 40. Although the spout insert 40 is depicted as unitary in the illustrated embodiment, it should be appreciated that the spout insert 40 may comprise multiple separate inserts, e.g., one insert corresponding to the first spout 110, and one insert corresponding to the second spout 80. Like the first and second spouts 110, 80, the spout insert 40 may be made of a resilient material, such as silicone or the like. The spout insert 40 may have a shape that generally conforms to the internal contour of the main body 60 of the lid portion. For example, in the illustrated embodiment, the spout insert 40 and the main body 60 of the lid portion 270 are both generally dome shaped. Further, the main body 60 and the spout insert 40 may each include vents 210, 120 that generally align when the spout insert 40 is inserted into the main body 60 and facilitate air movement into the base portion 50 during drinking. Furthermore, the spout insert 40 can be positioned over, and form an airtight seal with, the rim of the base portion 50.

Furthermore, as depicted in FIG. 4, the spout insert 40 comprises a first vent 210 passing therethrough. The lid portion 270 may comprise a second vent 120 passing therethrough that is generally aligned with the first vent 120. The lid portion 270 can be configured for threadedly receiving the base portion 50 as depicted in FIG. 4.

FIGS. 5-10 are perspective, top, bottom, front, rear and side views, respectively, of the spout insert 40, in accordance with various embodiments of the present invention. In the illustrated embodiment, the spout insert 40 includes an oblong first spout 110 through which a beverage in the base portion 50 may be consumed. An upper portion of the oblong spout 110, where the lips are applied, may be sized and shaped as appropriate to fit comfortably within the user's (e.g., a child's) mouth and deliver the liquid contained in the base through the first spout 110. The end of the first spout 110 may one or more slits to allow a beverage to pass through while also reducing spills. In another embodiment, the end of the first spout 110 may have one or more holes in conjunction with or in lieu of the slit to allow a beverage to pass through.

In the illustrated embodiment, the first spout 110 and second spout 80 may extend perpendicular from the spout insert 40 and substantially parallel to each other and are forced into angles relative to each other when the spout insert 40 is inserted into the main body 60. In other embodiments, the first spout 110 and second spout 80 may extend at non-perpendicular angles from the spout insert 40. The spout insert 40 may be a molded, clear, flexible plastic part, such that it seals with the base portion 50 and allows the user to withdraw liquid from the cup while preventing accidental spilling of liquid.

Thus, beverage containers according to various embodiments overcome conventional containers' that drawback of preventing effective progressive training drinking apparatus for growing children. Users have more longevity of the container because children tend to use the oblong spout first before transitioning to the straw-like spout. As children grow older, they may prefer to use the straw-like spout. Moreover, having a unitary structure that offers multiple drinking alternatives reduces parts and kitchen storage clutter. Various embodiments have multiple different sized and/or shaped drinking spouts, such as an oblong spout and a straw-like spout, which allows for effective progressive training for children.

It should be understood that arrangements described herein are for purposes of example only. As such, those skilled in the art will appreciate that other arrangements and other elements can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. On the contrary, this disclosure covers all methods, apparatus, and articles of manufacture fairly falling within the scope of the appended claims either literally or under the doctrine of equivalents. It is also to be understood that the terminology used herein is for the purpose of describing particular implementations only, and is not intended to be limiting.

We claim:

1. A beverage container comprising:

a base portion for holding a beverage; and a lid portion that is selectively attachable to the base, the lid portion comprising:

a first spout through which a beverage in the container may be consumed;

a second spout through which the beverage may be consumed, the second spout having a different shape than the first spout; and a cover assembly configured to selectively cover, and expose for drinking therefrom, the first spout and the second spout, wherein the cover assembly comprises a first cover pivotable between a first closed position and a first open position, and a second cover pivotable between a second closed position and a second open position, each of the first cover and second cover pivotable about a same point.

2. The beverage container of claim 1, wherein the cover assembly is configurable into a first configuration in which both the first spout and the second spout are covered.

3. The beverage container of claim 2, wherein the cover assembly is configurable into a second configuration in which the first spout is exposed for drinking therefrom and the second spout is covered.

4. The beverage container of claim 3, wherein the cover assembly is configurable into a third configuration in which the second spout is exposed for drinking therefrom and the first spout is covered.

5. The beverage container of claim 1, wherein the first cover includes a raised portion to facilitate manipulation of the first cover.

6. The beverage container of claim 1, wherein the lid portion comprises a vent.

7. The beverage container of claim 1, wherein the first spout is comprised of a resilient material.

8. The beverage container of claim 7, wherein the resilient material comprises silicone.

9. The beverage container of claim 1, wherein the lid portion includes a unitary spout insert that comprises the first and second spouts.

10. The beverage container of claim 9, wherein the spout insert comprises a first air-flow permit passing therethrough.

11. The beverage container of claim 10, wherein the lid portion comprises a main body having a second air-flow permit passing therethrough that is generally aligned with the first air-flow permit when the spout insert is inserted into the main body.

12. The beverage container of claim 1, wherein the first spout is a straw-like spout and comprises an external end adapted for drinking therefrom and internal end, and wherein the beverage container further comprises a straw member that is selectively attachable to the internal end of the first spout.

13. The beverage container of claim 1, wherein the beverage container is in a form selected from the group consisting of a cup, a mug, a jug, a bottle, and a can.

14. The beverage container of claim 1, further comprising a handle portion connectable to the base portion.

15. The beverage container of claim 14, wherein the handle portion is integrated into the base portion.

16. The beverage container of claim 1, wherein the lid portion further comprises a main body, and wherein the point about which each of the first cover and second cover are pivotable is a male hinge portion disposed on the main body.

17. The beverage container of claim 16, wherein:

the first cover further comprises a first female hinge portion;

the second cover further comprises a second female hinge portion; and each of the first female hinge portion and the second female hinge portion rotatably couple to the male hinge portion.

18. A spout insert and a lid portion for a beverage container, the spout insert comprising:

a unitary structure comprising:

an oblong spout; and a straw-like spout, wherein the spout insert is positionable within the lid portion of the beverage container, and the lid portion comprising:

a first cover over the oblong spout pivotable between a first closed position and a first open position, and a second cover over the straw-like spout pivotable between a second closed position and a second open position, each of the first cover and the second cover pivotable about a same point.

19. The spout insert and lid portion of claim 18, wherein the spout insert is configurable to abut under a main body of the lid portion.

20. The spout insert and lid portion of claim 18, wherein the spout insert is comprised of a resilient material.

21. The spout insert and lid portion of claim 20, wherein the resilient material comprises silicone.

22. The spout insert and lid portion of claim 18, wherein the unitary structure comprises an air vent passing therethrough.

23. The spout insert and lid portion of claim 22, wherein the unitary structure further comprises a dome-shaped portion located at least in part between the oblong spout and the straw-like spout, and further wherein the air vent is disposed at a top of the dome-shaped portion of the unitary structure.

24. A beverage container comprising:

a base portion for holding a beverage; and a lid portion that is selectively attachable to the base portion, the lid portion comprising:

a unitary and selectively removable silicone spout insert, comprising:

an oblong spout through which a beverage in the container may be consumed; and a straw-like spout through which the beverage may be consumed; and a cover assembly configured to selectively cover, and expose for drinking therefrom, the oblong spout and the straw-like spout, wherein:

the lid portion further comprises a main body comprising a first vent passing therethrough;

the spout insert further comprises a second vent passing therethrough;

the first vent of the main body generally aligns with the second vent of the spout insert; and the spout insert forms an airtight seal with a rim of the base portion.

* * * * *